US008348746B2

(12) United States Patent
Wilson et al.

(10) Patent No.: US 8,348,746 B2
(45) Date of Patent: Jan. 8, 2013

(54) REEL BLUR FOR GAMING MACHINES HAVING SIMULATED ROTATING REELS

(75) Inventors: Zachery Tyler Wilson, Reno, NV (US); Jae Man Yi, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/207,260

(22) Filed: Aug. 10, 2011

(65) Prior Publication Data

US 2011/0294562 A1 Dec. 1, 2011

Related U.S. Application Data

(63) Continuation of application No. 11/859,127, filed on Sep. 21, 2007, now Pat. No. 8,012,010.

(51) Int. Cl.
*A63F 9/24* (2006.01)

(52) U.S. Cl. ..... 463/20; 463/2; 463/4

(58) Field of Classification Search ..... 463/20, 463/2, 4

See application file for complete search history.

(56) References Cited

U.S. PATENT DOCUMENTS

| | | | |
|---|---|---|---|
| 3,708,219 | A | 1/1973 | Forlini et al. |
| 4,333,715 | A | 6/1982 | Brooks |
| 4,517,558 | A | 5/1985 | Davids |
| 4,607,844 | A | 8/1986 | Fullerton |
| 4,621,814 | A | 11/1986 | Stephen et al. |
| 4,659,182 | A | 4/1987 | Aizawa |
| 4,718,672 | A | 1/1988 | Okada |
| 4,911,449 | A | 3/1990 | Dickinson et al. |
| 4,912,548 | A | 3/1990 | Shanker et al. |
| 5,086,354 | A | 2/1992 | Bass et al. |
| 5,113,272 | A | 5/1992 | Reamey |
| 5,132,839 | A | 7/1992 | Travis |
| 5,319,491 | A | 6/1994 | Selbrede |
| 5,342,047 | A | 8/1994 | Heidel et al. |
| 5,364,100 | A | 11/1994 | Ludlow et al. |
| 5,376,587 | A | 12/1994 | Buchmann et al. |

(Continued)

FOREIGN PATENT DOCUMENTS

| | | |
|---|---|---|
| EP | 0 454 423 | 10/1991 |

(Continued)

OTHER PUBLICATIONS

U.S. Appl. No. 11/938,086, filed Nov. 9, 2007.

(Continued)

*Primary Examiner* — Pierre E Elisca

(74) *Attorney, Agent, or Firm* — Weaver Austin Villeneuve & Sampson LLP

(57) ABSTRACT

Methods for emulating rotating physical reels on a display screen are disclosed. Graphics for "static" reel symbols are intentionally blurred for those reel symbols "in motion." Gaming machines include an exterior housing, master gaming controller, display device and virtual reels. Virtual reels include reel stops, static reel symbols and corresponding dynamic blurred reel symbols. A blurred reel symbol generator provides corresponding blurred reel symbols for existing static reel symbols, and can be located at a remote host and/or within the gaming machine. A remote host can provide downloadable virtual reel strips, reel symbols and blurred reel symbols to gaming machines. The blurred reel symbol generator can accept manually entered blurred reel symbol images, and/or can also generate blurred reel symbol images itself in automated fashion. Blurred reel symbols can be generated on the fly at runtime, or can be taken from a stored location.

20 Claims, 8 Drawing Sheets

U.S. PATENT DOCUMENTS 5,393,061 A 2/1995 Manship et al.
5,467,893 A 11/1995 Landis, II et al.
5,539,547 A 7/1996 Ishii et al.
5,580,055 A 12/1996 Hagiwara et al.
5,585,821 A 12/1996 Ishikura et al.
5,589,980 A 12/1996 Bass et al.
5,725,428 A 3/1998 Achmueller
5,745,197 A 4/1998 Leung et al.
5,752,881 A 5/1998 Inoue
5,764,317 A 6/1998 Sadnovik et al.
5,910,046 A 6/1999 Wada et al.
5,951,397 A 9/1999 Dickinson
5,956,180 A 9/1999 Bass et al.
5,967,893 A 10/1999 Lawrence et al.
6,001,016 A 12/1999 Walker et al.
6,015,346 A 1/2000 Bennett
6,027,115 A 2/2000 Griswold et al.
6,050,895 A 4/2000 Luciano et al.
6,054,969 A 4/2000 Haisma
6,059,658 A 5/2000 Mangano et al.
6,135,884 A 10/2000 Hedrick et al.
6,159,098 A 12/2000 Slomiany et al.
6,213,875 B1 4/2001 Suzuki
6,244,596 B1 6/2001 Kondratjuk
6,251,014 B1 6/2001 Stockdale et al.
6,252,707 B1 6/2001 Kleinberger et al.
6,254,481 B1 7/2001 Jaffe
6,315,666 B1 11/2001 Mastera et al.
6,337,513 B1 1/2002 Clevenger et al.
6,347,996 B1 2/2002 Gilmore et al.
6,368,216 B1 4/2002 Hedrick et al.
6,379,244 B1 4/2002 Sagawa et al.
6,398,220 B1 6/2002 Inoue
6,416,827 B1 7/2002 Chakrapani et al.
6,444,496 B1 9/2002 Edwards et al.
6,445,185 B1 9/2002 Damadian et al.
6,491,583 B1 12/2002 Gauselmann
6,503,147 B1 1/2003 Stockdale et al.
6,511,375 B1 1/2003 Kaminkow
6,512,559 B1 1/2003 Hashimoto et al.
6,514,141 B1 2/2003 Kaminkow et al.
6,517,433 B2 2/2003 Loose et al.
6,517,437 B1 2/2003 Wells et al.
6,547,664 B2 4/2003 Saunders
6,575,541 B1 6/2003 Hedrick et al.
6,585,591 B1 7/2003 Baerlocher et al.
D480,961 S 10/2003 Deadman
6,646,695 B1 11/2003 Gauselmann
6,652,378 B2 11/2003 Cannon et al.
6,659,864 B2 12/2003 McGahn et al.
6,661,425 B1 12/2003 Hiroaki
6,695,696 B1 2/2004 Kaminkow
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,802,777 B2 10/2004 Seelig et al.
6,817,945 B2 11/2004 Seelig et al.
6,817,946 B2 11/2004 Motegi et al.
6,887,157 B2 5/2005 LeMay et al.
6,890,259 B2 5/2005 Breckner et al.
6,906,762 B1 6/2005 Witehira et al.
6,937,298 B2 8/2005 Okada
7,095,180 B2 8/2006 Emslie et al.
7,097,560 B2 8/2006 Okada
7,128,647 B2 10/2006 Muir
7,159,865 B2 1/2007 Okada
7,160,187 B2 1/2007 Loose et al.
7,204,753 B2 4/2007 Ozaki et al.
7,207,883 B2 4/2007 Nozaki et al.
7,220,181 B2 5/2007 Okada
7,252,288 B2 8/2007 Seelig et al.
7,255,643 B2 8/2007 Ozaki et al.
7,309,284 B2 12/2007 Griswold et al.
7,322,884 B2 1/2008 Emori et al.
7,329,181 B2 2/2008 Hoshino et al.
8,012,010 B2 9/2011 Wilson et al.
2001/0013681 A1 8/2001 Bruzzese et al.
2002/0045472 A1 4/2002 Adams
2002/0173354 A1 11/2002 Winans et al.
2003/0027624 A1 2/2003 Gilmore et al.
2003/0032478 A1 2/2003 Takahama et al.
2003/0032479 A1 2/2003 LeMay et al.
2003/0087690 A1 5/2003 Loose et al.
2003/0130028 A1 7/2003 Aida et al.
2003/0176214 A1 9/2003 Burak et al.
2003/0236114 A1 12/2003 Griswold et al.
2004/0023714 A1 2/2004 Asdale
2004/0029636 A1 2/2004 Wells et al.
2004/0063490 A1 4/2004 Okada
2004/0066475 A1 4/2004 Searle
2004/0116178 A1 6/2004 Okada
2004/0147303 A1 7/2004 Imura et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183972 A1 9/2004 Bell
2004/0192430 A1 9/2004 Blankstein et al.
2004/0198485 A1 10/2004 Loose et al.
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0224747 A1 11/2004 Okada
2004/0233663 A1 11/2004 Emslie et al.
2004/0239582 A1 12/2004 Seymour
2005/0032571 A1 2/2005 Asonuma
2005/0037843 A1 2/2005 Wells et al.
2005/0049032 A1 3/2005 Kobayashi
2005/0049033 A1 3/2005 Kojima
2005/0049046 A1 3/2005 Kobayashi
2005/0062410 A1 3/2005 Bell
2005/0063055 A1 3/2005 Engel
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0192090 A1 9/2005 Muir et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0266912 A1 12/2005 Sekiguchi
2005/0285337 A1 12/2005 Durham et al.
2006/0058100 A1 3/2006 Pacey et al.
2006/0100014 A1 5/2006 Griswold et al.
2006/0103951 A1 5/2006 Bell et al.
2006/0125745 A1 6/2006 Evanicky
2006/0166727 A1 7/2006 Burak
2006/0191177 A1 8/2006 Engel
2006/0284574 A1 12/2006 Emslie et al.
2006/0290594 A1 12/2006 Engel
2007/0004510 A1 1/2007 Underdahl et al.
2007/0004513 A1 1/2007 Wells et al.
2007/0010315 A1 1/2007 Hein
2007/0105611 A1 5/2007 O'Halloran
2008/0004104 A1* 1/2008 Durham et al. ..... 463/20
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0108422 A1 5/2008 Hedrick et al.
2009/0082083 A1 3/2009 Wilson et al.
2009/0280888 A1* 11/2009 Durham et al. ..... 463/20
2009/0312095 A1* 12/2009 Durham et al. ..... 463/30
2010/0190545 A1* 7/2010 Lauzon et al. ..... 463/20
2010/0234089 A1 9/2010 Saffari et al.

FOREIGN PATENT DOCUMENTS

| | | | |
|---|---|---|---|
| EP | 0 484 103 | A2 | 5/1992 |
| EP | 0 997 857 | | 5/2000 |
| EP | 1 260 928 | | 11/2002 |
| EP | 1 282 088 | A2 | 2/2003 |
| EP | 1 391 847 | | 2/2004 |
| EP | 1 462 152 | A2 | 9/2004 |
| GB | 1 464 896 | | 2/1977 |
| JP | 2000-300729 | | 10/2000 |
| JP | 2000-350805 | | 12/2000 |
| JP | 2001-062032 | | 3/2001 |
| JP | 2001-238995 | | 9/2001 |
| JP | 2001-252393 | | 9/2001 |
| JP | 2001-252394 | | 9/2001 |
| JP | 2001-353254 | | 12/2001 |
| JP | 2002-085624 | | 3/2002 |
| JP | 2004-089707 | | 3/2004 |
| JP | 2004-105616 | | 4/2004 |
| JP | 2004-166879 | | 6/2004 |
| JP | 2005-253561 | | 9/2005 |
| JP | 2005-266387 | | 9/2005 |
| JP | 2005-266388 | | 9/2005 |
| JP | 2005-274906 | | 10/2005 |
| JP | 2005-274907 | | 10/2005 |
| JP | 2005-283864 | | 10/2005 |
| JP | 2006-043425 | | 2/2006 |
| JP | 2006-346226 | | 12/2006 |
| WO | WO 99/42889 | | 8/1999 |
| WO | WO 99/44095 | | 9/1999 |
| WO | WO 01/15128 | | 3/2001 |
| WO | WO 01/15132 | | 3/2001 |
| WO | WO 01/09664 | | 8/2001 |
| WO | WO 02/65192 | | 8/2002 |
| WO | WO 03/039699 | | 5/2003 |
| WO | WO 2004/001486 | | 12/2003 |
| WO | WO 2004/102520 | | 11/2004 |
| WO | WO 2006/038819 | | 4/2006 |
| WO | WO2009/039295 | | 3/2009 |

OTHER PUBLICATIONS

U.S. Appl. No. 11/938,151, filed Nov. 9, 2007.
U.S. Appl. No. 11/858,849, filed Sep. 20, 2007.
U.S. Appl. No. 11/858,695, filed Sep. 20, 2007.
U.S. Appl. No. 11/858,845, filed Sep. 20, 2007.
U.S. Appl. No. 11/849,119, filed Aug. 31, 2007.
U.S. Appl. No. 11/877,611, filed Oct. 23, 2007.
U.S. Appl. No. 11/938,184, filed Nov. 9, 2007.
U.S. Office Action dated Nov. 12, 2010 issued in U.S. Appl. No. 11/859,127.
U.S. Notice of Allowance dated May 4, 2011 issued in U.S. Appl. No. 11/859,127.
U.S. Office Action dated Aug. 31, 2004 issued in U.S. Appl. No. 10/213,626.
U.S. Office Action Final dated Jan. 10, 2006 issued in U.S. Appl. No. 10/213,626.
U.S. Office Action dated Apr. 27, 2006 issued in U.S. Appl. No. 10/213,626.
U.S. Office Action Final dated Mar. 28, 2007 issued in U.S. Appl. No. 10/213,626.
U.S. Office Action dated Oct. 31, 2007 issued in U.S. Appl. No. 10/213,626.
EP Examination Report dated Sep. 13, 2007 issued in EP 05 705 315.9.
PCT International Search Report dated May 7, 2008 issued in WO 2008/063914.
PCT Written Opinion dated May 7, 2008 issued in WO 2008/063914.
Bonsor, Kevin (2002), "How Smart Windows Will Work," *Howstuffworks, Inc.* 1998-2002, [retrieved from the Internet on Nov. 25, 2002] at http://www/howstuffworks.com/smart-window.htm/printable, 5 pgs.
Bonser, Kevin (2004) "How Smart Windows Work," *HowStuffWorks, Inc.*, 1998-2004, retrieved from the Internet on Apr. 1, 2004 at http://www.howstuffworks.com, 9 pgs.
Debut of the Let's Make a Deal Slot Machine (2002), *The Official Let's Make a Deal Website at www.letsmakeadeal.com*, 1999-2002, modified Jan. 2, 2002; downloaded from Internet on Dec. 3, 2002 at http:///www.letsmakeadeal.com/pr01.htm, 2 pgs.
Light Valve (2005), *www.meko.co.uk*, [retrieved from the Internet on Nov. 15, 2005] at http://www.meko.co.uk/lightvalve.shtml, 1 page.
Liquid Crystal Display (2005), *Wikipedia.org*, [retrieved from the Internet on Nov. 16, 2005] at http://en.wikipedia.org/wiki/LCD, 6 pgs.
Novel 3-D Video Display Technology Developed, News release on Aug. 30, 1996; [Retrieved from Internet at http://www.eurekalert.org/summaries/1199.html (archive) on Sep. 2, 2000; Feb. 14, 2003], 2 page.
Saxe et al. (1996) "Suspended-Particle Devices," Refr-spd.com, retrieved from the Internet on Apr. 1, 2004 at http://www.refr-spd.com, vol. Information Display Apr./May 1996, 5 pgs.
SPD (1999), *Malvino Inc.*, retrieved from the Internet on Jul. 19, 1999 at http://www.malvino.com, 10 pgs.
Time Multiplexed Optical Shutter (TMOS): A revolutionary Flat Screen Display Technology, www.tralas.com/TMOS.html, Apr. 5, 2001, printed from Internet Archive using date Apr. 11, 2001; 5 pgs.
Time Multiplexed Optical Shutter (TMOS): A revolutionary Flat Screen Display Technology, www.vea.com/TMOS.html, Apr. 8, 1999, printed from Internet Archive using date Oct. 6, 1999; 6 pgs.
What is SPD? (2002), *www.SPD Systems, Inc.*, [retrieved from the Internet on Dec. 4, 2002] at http://www.spd-systems.com/spdq.htm, 2 pgs.
Third Party Submission for U.S. Appl. No. 13/207,260 dated Jan. 31, 2012.
PCT International Search Report dated Dec. 11, 2008 issued in PCT/US2008/076881 [WO2009/039295].
PCT Written Opinion dated Dec. 11, 2008 issued in PCT/US2008/076881 [WO2009/039295].
PCT International Preliminary Report on Patentability and Written Opinion dated Mar. 24, 2010 issued in PCT/US2008/076881 [WO2009/039295].

* cited by examiner

REEL BLUR FOR GAMING MACHINES HAVING SIMULATED ROTATING REELS

RELATED APPLICATION DATA

This application claims priority under U.S.C. 120 and is a continuation of U.S. application Ser. No. 11/859,127, filed Sep. 21, 2007, titled, "Reel Blur For Gaming Machines Having Simulated Rotating Reels," by Wilson, et al., which is incorporated herein by reference in its entirety and for all purposes.

TECHNICAL FIELD

The present invention relates generally to wager based gaming machines, and more specifically to the presentation of simulated rotating reels on processor-based gaming machines.

BACKGROUND

A "mechanical reel" type gaming machine generally refers to a slot machine having traditional physical rotating reels with their associated latches and mechanical parts. A mechanical reel usually has a fixed number of reel symbols disposed about a reel strip attached about the circumference of a wheel. A motor, spring, or other mechanical system physically spins the wheel until it stops at a particular rotational position or "reel stop" and a particular symbol rests in view of a player to indicate an outcome for that reel for a given reel game. Accordingly, most reel symbols are associated with a corresponding reel stop on their respective gaming reels. In many older machines, the reels and symbols were spun by potential energy first stored in a spring-loaded mechanism wound and then actuated by the pull of a traditional pull-arm handle. Each reel was stopped at a random position by a mechanical device. The slot machine sensed an outcome, usually along a central payline, by sensing the physical position of each reel.

Although popular throughout recent history, these mechanically driven reel slot machines are being steadily replaced by electronic gaming machines, some of which are specifically adapted to simulate such reel based games on a video display, such as a CRT, LCD flat panel display or the like. Processor-based gaming machines are becoming the norm. One reason for their increased popularity is the nearly endless variety of games that can be implemented using processor-based technology. The processor-based gaming machines permit the operation of more complex games, advance player tracking, improve security, permit wireless communications, and add a host of digital features that are not be possible on mechanical-driven gaming machines.

In a typical gaming machine, such as a processor-based gaming machine adapted to simulated multiple rotating reels, a game play is first initiated through a player wager of money or credit, whereupon the gaming machine determines a game outcome, presents the game outcome to the player and then potentially dispenses an award of some type, including a monetary award, depending upon the game outcome. Electronic and microprocessor based gaming machines can include a variety of hardware and software components to provide a wide variety of game types and game playing capabilities, with such hardware and software components being generally well known in the art. A typical electronic gaming machine can include hardware devices and peripheral such as bill validators, coin acceptors, card readers, keypads, buttons, levers, touch screens, coin hoppers, player tracking units and the like. In addition, each gaming machine can have various audio and visual display components that can include, for example, speakers, display panels, belly and top glasses, exterior cabinet artwork, lights, and top box dioramas, as well as any number of video displays of various types to show game play and other assorted information.

In many reel-based gaming machines, each reel within a plurality of reels or simulated reels typically includes a number of reel stops, at least some of which contain reel symbols. Such reel symbols can include various fruits, bells, bars, gems and/or numbers (such as a "lucky 7"), as well as a wide variety of other symbols, shapes or designs. A typical mechanical gaming machine might have, for example, 17 reel stops per reel, although this number can vary. Such a reel would then tend to have 17 equally sized sections within which reel symbols might be placed. Simulated or "virtual" gaming reels for processor-based gaming machines can also be designed so as to have a specific number of reel stops, as well as specific reel symbols and designated relative positions for each about the circumference of the virtual reel.

Advances in technology have resulted in processor-based gaming machines that are increasingly better at emulating actual mechanical reels from a fully mechanical or electromechanical reel-based gaming machine. Various efforts to simulate or realistically emulate mechanical reels on a video screen of a processor-based gaming machine abound. Some of such efforts can be found at, for example, U.S. Pat. No. 6,887,157, entitled "Virtual Camera and 3-D Gaming Environments in a Gaming Machine," as well as at Japanese Patent Publication No. 2006346226A2, entitled "Game Device and Game Program." Another reference that involves rotating reel games having processors is U.S. patent Publication No. 2005/0285337, entitled "Dynamic Generation of a Profile for Spinning Reel Gaming Machines," and there are numerous other known instances of machines and systems involving rotating reel games that are controlled at least in part by a microprocessor.

One issue that is common to providing simulated or "virtual" rotating gaming reels on a video display is the display of a realistic emulation of such reels while they are rotating. As is well known, true physical mechanical (i.e., analog) reels are typically spun during game play at such a rapid speed so as to blur all reel symbols together into one vague and largely unrecognizable blended streak for each reel. Although the naked eye might be able to detect when a particular already known reel symbol whizzes by, there are so many reel symbols traveling at such a high rate of speed for each reel that it is almost impossible for a human eye to isolate and comprehend a clear picture of any given reel symbol as it is moving during a typical game play reel spin. As such, the accurate simulation of rapidly moving physical reels has not been one of the most urgent concerns in many video simulations of reel based games to date.

Many prior efforts to simulate moving mechanical reels on a video screen presentation generally fall into one of two categories. The first category includes the use of a preset or "canned" video representation that is played whenever reels are "set in motion" via a player input, such as a start game button selection. In such instances, visual simulations of static reels at rest are replaced by a video clip that is intended to represent those same reels as they might appear to be rapidly spinning. This spinning reel video clip "simulation" is then ended when the new positions of the reels as a result of the game play is determined and the reels are shown in static form again, only in the new position(s) due to the game outcome. One of the problems with the use of such a "canned" video clip is that a clip or movie representation of simulated rotating reels tends to be the same clip every time, regardless of the actual starting and ending static positions of the reel before and after game play. Such a repeat and identical visual presentation of "moving reels" can be cartoonish and unrealistic for players who have seen the same presentation more than a few times.

The second general category of moving reel simulations on a video screen involves the rapid generation and regeneration of the actual reel symbols in clear and fine detail as they are intended to rush across the video display in real time. The ability to generate such rapid drawing and redrawing of graphical components that are moving at a high rate of speed has been aided greatly in recent times via significant advances in computing and graphical arts technologies. Unfortunately, the basic nature of the human eye has not advanced at the same pace as computing and display technologies. While a clear and accurate image, such as a reel symbol, can be drawn and redrawn again many times over in a fraction of a second, so as to emulate actual movement in a fairly accurate manner, the naked eye typically processes new images comfortably at a rate of about twenty to thirty frames per second, regardless of what speed is actually used. Such general knowledge regarding the limitations of the human eye tends to dictate how television transmissions are made and presented, among other examples of visual presentations.

In addition, the frame by frame presentation of an emulated analog event is by definition a "jumpy" presentation of simulated images that are never as fluid moving or natural as they would be in real life. For example, the movement of numerous graphical reel symbols against a white reel strip background results in a frame by frame "flashing" or flickering of colored symbol, to white, to colored symbol, back to white, and so forth for any given spot on which an eye might be focused. Such flickering is comparable to a strobe light or rapid on and off switching of an overhead light as far as a typical human eye is concerned. Even with modern technology, the rapid changes in luminescence that an eye experiences when viewing such a simulated animation on a video screen is simply unlike the experience that is had while viewing a real analog rotating reel in real time.

As such, the reasonably accurate, yet rapid, drawing and redrawing of clear and fast moving visual images can put undue strain and/or fatigue on the eyes of many viewers. Further, since it can be reflexive for the human eye to attempt to move with a rapidly moving object, the eye may perceive and attempt to move with a reel symbol that appears to be moving rapidly across the screen, such as by drawing and redrawing the reel symbol at a rate of sixty frames per second or more. This, in addition to the rapid changes in luminescence for numerous points of focus on a video simulated rotating reel can fatigue the eyes and concentration of viewers much more quickly than an ordinary analog spinning reel would. Such issues can be exacerbated during gaming sessions that last an extended period of time for a player at a particular gaming machine or machines that are so affected. While such video presentations of emulated spinning reels can thus be fairly realistic to some degree, the resultant eye strain, eye fatigue, possible headaches and/or related general displeasure of some viewers can cause problems with the perceptions of some players and potential players that simulated rotating reels are for at least some reasons less than desirable in comparison with the real thing.

While existing designs and systems for providing realistic reel games on processor-based gaming machines, and particularly the presentation of spinning reels on the video displays thereof, have been adequate in the past, improvements are usually welcomed and encouraged. In light of the foregoing, it is thus desirable to develop improved processor-based gaming machines that provide even better emulation of reel-based games, particularly with respect to reels that are in motion.

SUMMARY

It is an advantage of the present invention to provide processor-based gaming machines that are adapted to present realistic emulations of reel-based games, particularly with respect to simulated rotating reels that are in motion, such that these gaming reels are more appealing to players. This can be accomplished at least in part through the use of simulated or "virtual" gaming reels having substitute reel symbols that are deliberately blurred and used in place of various static reel symbols when the virtual gaming reels are depicted in motion. It is an additional advantage of the present invention to provide a reel blur generator that is adapted to generate or otherwise provide substitute blurred reel symbols in place of various corresponding static reel symbols for this purpose.

In various embodiments of the present invention, a processor-based gaming machine adapted for accepting a wager, playing a game based on the wager and granting a payout based on the result of the game is provided. Such a gaming machine can include an exterior housing arranged to contain various internal gaming machine components therein, a master gaming controller in communication with various internal gaming machine components and adapted to execute or control one or more aspects of the wager based game, a display device in communication with the master gaming controller and adapted to present a plurality of simulated rotating reels, a reel blur generator in communication with at least one of said master gaming controller and said display device, or both. The plurality of simulated rotating reels can have a plurality of reel symbols distributed on a plurality of reel stops thereupon, and the reel blur generator can be adapted to facilitate the display of the simulated rotating reels upon the display device, such as by reconfiguring at least one of the simulated rotating reels such that one or more reel symbols are replaced by one or more corresponding substitute blurred reel symbols when the simulated rotating reels are depicted in motion on the display device.

In various embodiments, a virtual gaming reel adapted for use in a processor-based, wager-based gaming environment is provided. Such a virtual gaming reel can include a display region having a plurality of reel stops distributed about an outer circumference thereof, a plurality of static reel symbols for display thereon, and also a plurality of substitute blurred reel symbols for display thereon. Both static and blurred reel symbols can be located at various reel stops on the virtual gaming reel. The static reel symbols can be adapted for display when the virtual gaming reel is at rest, and at least some of these static reel symbols can be replaced by corresponding blurred reel symbols when the virtual gaming reel is in motion. Such a virtual gaming reel can be associated with other similar virtual gaming reels, and can be present on a gaming machine, gaming terminal, or elsewhere within a process-based, wager-based gaming system.

In various embodiments, a wager-based gaming system having a plurality of processor-based gaming machines is provided. Such processor-based gaming machines can include any of those recited above having virtual or simulated rotating reels with static reel symbols that have corresponding substitute blurred reel symbols, and such gaming machines may or may not have an internal reel blur generator. The wager-based gaming system can also include a remote host in communication with each of the processor-based gaming machines, with the remote host being adapted to download static reel symbols, substitute blurred reel symbols, full reel strips, or any combination thereof to the networked gaming machines. The wager-based gaming system can also include at least one reel blur generator in communication with the remote host, the gaming machines or both, with the one reel blur generator being adapted to facilitate the display of simulated rotating reels and is also adapted to reconfigure at least one of the simulated rotating reels such that one or more of the static reel symbols are replaced by one or more corresponding substitute blurred reel symbols when the simulated rotating reels are depicted in motion. A reel blur generator can be located at the remote host, within one or more of the gaming machines, or both.

Further features and items may also be found in any of the foregoing embodiments, and it will be readily appreciated that various combinations of the following features and items may be used. For example, some or all reel stops on a given reel can comprise an identical amount of space. In some embodiments, various corresponding substitute blurred reel symbols can appear blurry regardless of whether such blurred reel symbols are static or moving on an associated display device. Further, various substitute blurred reel symbols can be designed to simulate the appearance of their corresponding static reel symbols when such corresponding reel symbols are moving on an associated display device. The substitute blurred reel symbols can be larger in size than their corresponding static reel symbols in the direction of rotation of a respective simulated rotating reel, and can be the same size in a direction that is perpendicular to the direction of rotation of that same reel.

In various embodiments, every static reel symbol on a given simulated rotating reel is replaced by a corresponding substitute blurred reel symbol when that simulated rotating reel is depicted in motion on an associated display. Preferably, each substitute blurred reel symbol is designed to simulate the appearance of its corresponding static reel symbol when such corresponding static reel symbol is moving on the associated display. In some embodiments, one or more substitute blurred reel symbols are stretched with respect to its corresponding static reel symbol in the direction of rotation of their respective simulated rotating reels. Such blurred reel symbol stretching can result in a collective stretching such that each substitute blurred reel symbol substantially contacts another substitute blurred reel symbol at both of its top and bottom ends. One continuous "blur" across the entire simulated rotating reel can be one result of such blurred reel symbol stretching.

In various embodiments, which may include one or more of the foregoing embodiments and/or one or more of the foregoing features and items, a gaming machine can be adapted to present one or more simulated rotating reels on a display device such that the rotating reels appear to be in motion, and wherein the elapsed time for one reel stop to pass through a given point on the display device can be a given period of time selected from a wide range of possible time periods. In some embodiments, such a period of time can range from about 35 to 100 milliseconds. Such elapsed time can also range from about 50 to 60 milliseconds, and can also be about 57 milliseconds. Such an elapsed time can apply to any of the included reel stops, which reel stops may all be about the same size. Other periods of time outside these ranges may also be used, as desired.

In various embodiments, the reel blur generator can be adapted to generate one or more corresponding substitute blurred reel symbols automatically, such as when presented with one or more static reel symbols. In some embodiments, the reel blur generator can be adapted to reconfigure various simulated rotating reels with one or more substitute blurred reel symbols that have already been created, such as those that may be saved on an associated storage device, and/or those that may be provided to the reel blur generator via a download.

In various embodiments involving a gaming machine, the gaming machine can also include a storage device in communication with the reel blur generator, with such a storage device adapted to store a plurality of files with respect to substitute blurred reel symbols. Various gaming machine embodiments can also include a network interface coupling the gaming machine to various remotely located networked components, with such a network interface facilitating the downloading of static reel symbols, blurred reel symbols, virtual reel strips or any combination thereof to the gaming machine.

In further embodiments, various methods of presenting simulated reels on a processor-based gaming machine may also be provided. Such methods can include a first step of displaying on a display device of the processor-based gaming machine a plurality of simulated static reels in a static, non-rotating position, with such simulated static reels showing to a player of the gaming machine a first set of static reel symbols visibly located at a plurality of static reel stops. Further steps can include accepting a monetary value wager from said player, accepting a game-related input from said player, initiating the play of a wager-based game as a result of the game-related input, and displaying on the display device a plurality of simulated dynamic reels in rotational motion as an aspect of the wager-based game. The plurality of simulated dynamic reels can include a plurality of substitute blurred reel symbols located at a plurality of dynamic reel stops, wherein at least some of these substitute blurred reel symbols are designed to simulate the appearance of a corresponding static reel symbol. Additional method steps can include determining an outcome for the wager-based game, as well as redisplaying on the display device said plurality of simulated static reels in a static, non-rotating position. At this last step, the simulated static reels can show to the player a second set of static reel symbols visibly located at a plurality of static reel stops, wherein this second set of static reel symbols are different from the first set of static reel symbols, and are determined as a result of the wager-based game outcome.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive gaming reels and methods of presentation therefor.

DETAILED DESCRIPTION

Exemplary applications of apparatuses and methods according to the present invention are described as follows. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as definitive or limiting in scope or setting. Although these examples are described in sufficient detail to enable one skilled in the art to practice the invention, it will be understood that they are not limiting, such that other embodiments may be used and changes may be made without departing from the spirit and scope of the invention.

Described herein are various processor-based gaming machines adapted to present simulated or "virtual" gaming reels having static reel symbols and blurred reel symbols that correspond to such static reel symbols. In particular, various processor-based gaming machines and systems that emulate a mechanical reel wager-based slot machine are presented. These gaming machines can include a number of realism adaptations, such as audio, video and/or physical adaptations, where each contributes to the perception of a mechanically driven reel slot machine. Such gaming machines and systems can include a specialized reel blur generator that is used to facilitate the deliberate blurring of substitute or replacement blurred reel symbols. The display of simulated reels can then include static reel symbols when the reels are at rest and the corresponding blurred reel symbols when the reels are in motion.

Gaming Machines

Figure 1:
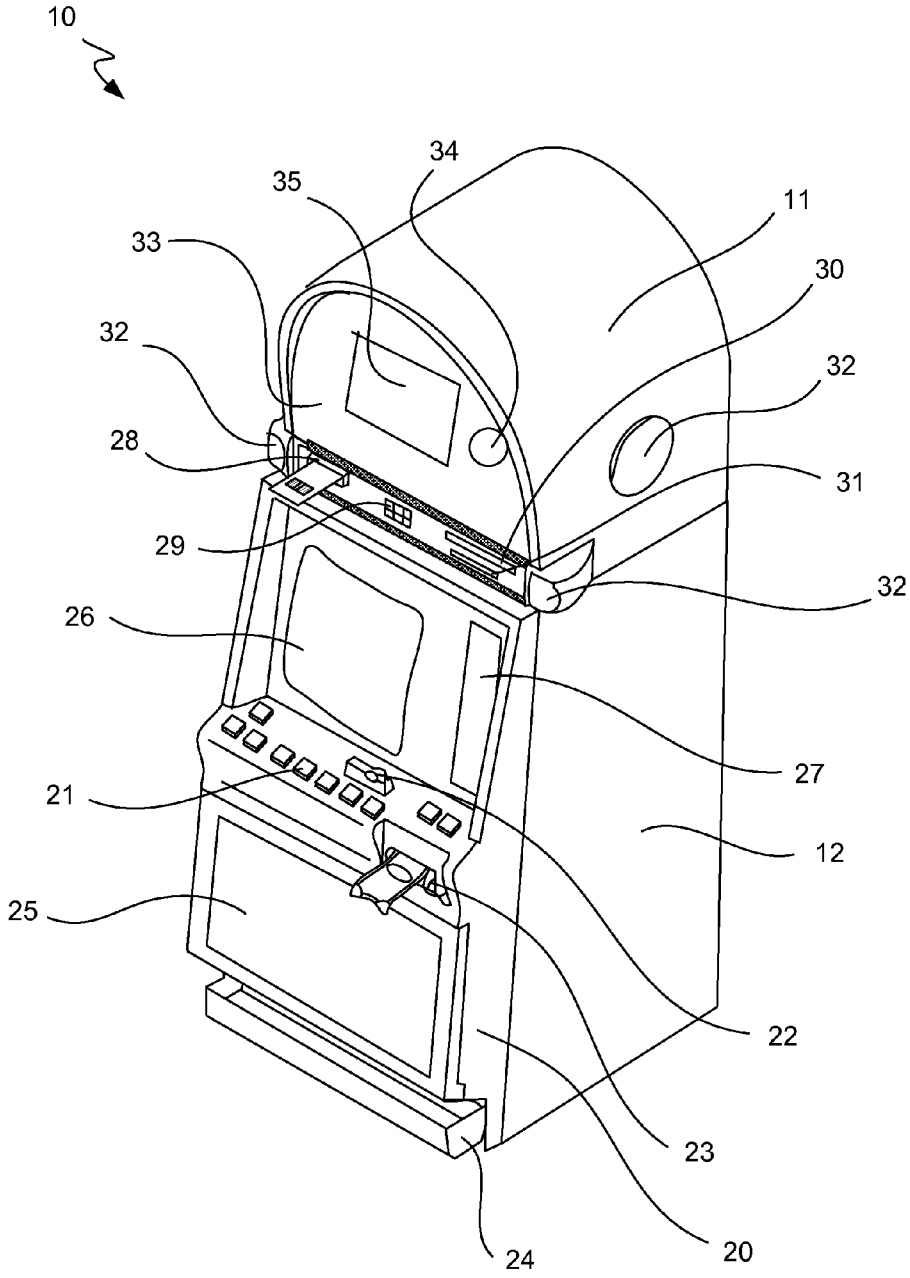
FIG. 1 illustrates in perspective view an exemplary gaming machine.

Referring first to FIG. 1, an exemplary processor-based gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, which collectively form a button panel, one or more money or credit acceptors, such as a coin acceptor 22 and a bill or ticket validator 23, a coin tray 24, and a belly glass 25. Viewable through main door 20 is a primary video display monitor 26 adapted to present a game and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket dispenser 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above. In particular, gaming machine 10 can be any of a wide variety of gaming machines manufactured and/or distributed by International Game Technology of Reno, Nev. ("IGT").

With respect to the basic gaming abilities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. Other features and functions may also be used in association with gaming machine 10, and it is specifically contemplated that the present invention can be used in conjunction with such a gaming machine or device that might encompass any or all such additional types of features and functions. In various preferred embodiments, gaming machine 10 can be adapted to present a video simulation of a reel based slots game involving a plurality of gaming reels.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage-monitoring circuitry, these types of circuits only report voltage status to the operating software. Out of tolerance voltages can cause software malfunction, creating a potential uncontrolled condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security-monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

General Gaming Network And System Configurations

Figure 2:
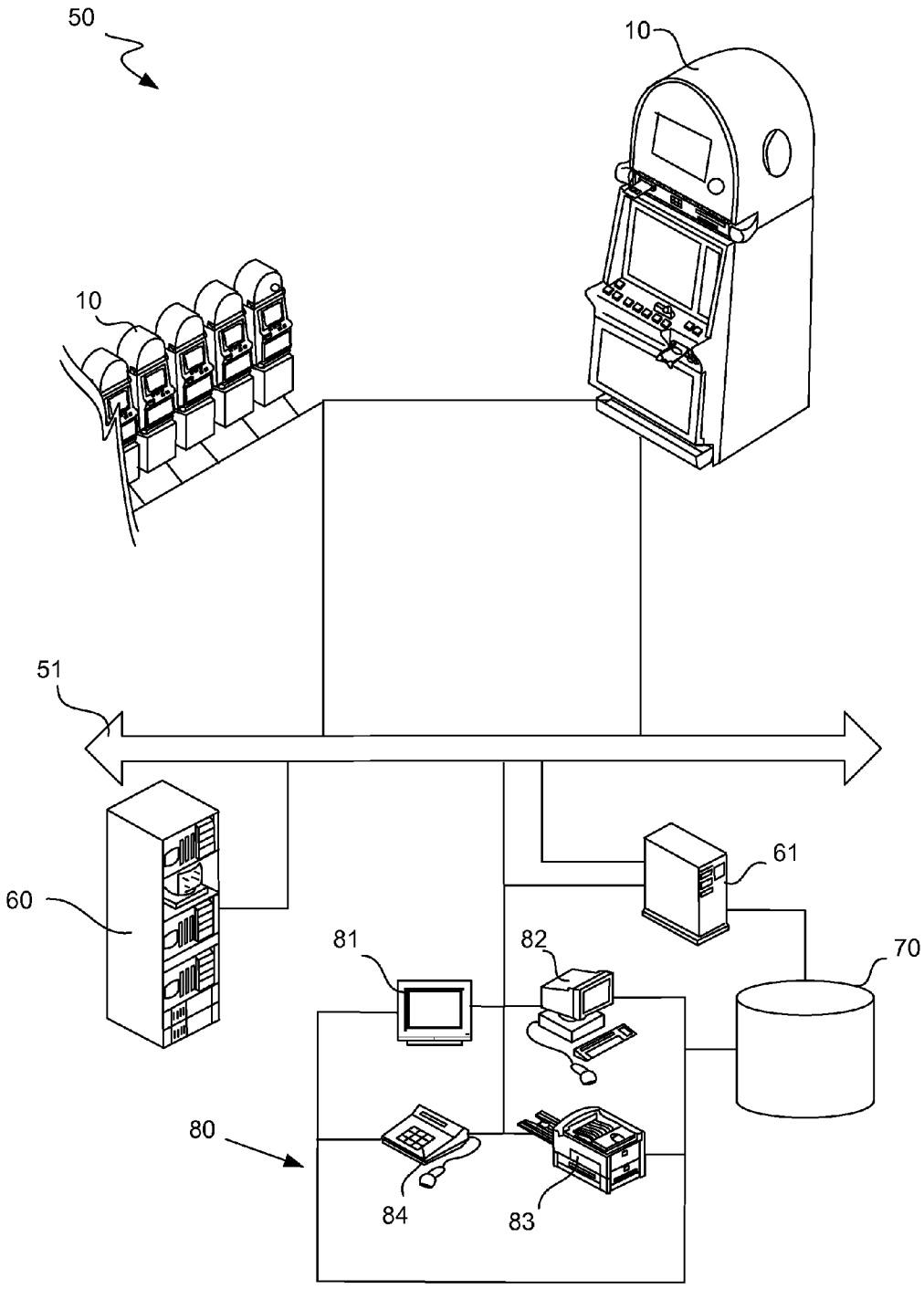
FIG. 2 illustrates in block diagram format an exemplary network infrastructure for providing a gaming system having one or more gaming machines.

Continuing with FIG. 2, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 61, a sub-network of peripheral devices 80, and/or a database 70.

A general-purpose server 60 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of cashless gaming and gaming machine administration and operation under the present methods and systems. Such a special-purpose server or servers could include, for example, a cashless gaming server, a player verification server, a general game server, a downloadable games server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a ticket validator or other security identifier, among others. Similarly, under either embodiment of an isolated or shared network, at least the specialized server 61 or another similar component within a general-purpose server 60 also preferably includes a connection to a database or other suitable storage medium 70. Database 70 is preferably adapted to store many or all files containing pertinent data or information for a particular purpose, such as, for example, data regarding visual image data, video clips, other displayable items, and/or related data, among other potential items. Files, data and other information on database 70 can be stored for backup purposes, and are preferably accessible at one or more system locations, such as at a general-purpose server 60, a special purpose server 61 and/or a cashier station or other sub-network location 80, as desired.

In some embodiments, one or both of general-purpose server 60 and special purpose server 61 can be adapted to download various games to one or more gaming machines 10. Such downloaded games can include reel-based slots type games, with various reel symbols and reel stop locations for such symbols being downloaded to the gaming machine or machines 10. Such downloads can occur based on a request or command from a player or a casino operator, or can take place in an automated fashion by system 50, such as via a particular prompt or trigger. In the event that reel symbols and reel stops are downloaded, such items may include one or more static reel symbols, one or more corresponding substitute blurred reel symbols, and/or one or more complete virtual reels having such static and blurred reel symbols, as might pertain to a given reel-type game as disclosed herein.

While gaming system 50 can be a system that is specially designed and created new for use in a casino or gaming establishment, it is also possible that many items in this system can be taken or adopted from an existing gaming system. For example, gaming system 50 could represent an existing cashless gaming system to which one or more of the inventive components or controller arrangements are added, such as controllers, storage media, and/or other components that may be associated with a dynamic display system adapted for use across multiple gaming machines and devices. In addition to new hardware, new functionality via new software, modules, updates or otherwise can be provided to an existing database 70, specialized server 61 and/or general-purpose server 60, as desired. Other modifications to an existing system may also be necessary, as might be readily appreciated.

Reel Symbol Blurring and Configuration

As noted above, a typical reel-based gaming machine includes a plurality of reels that are each divided into numerous reel stops or symbol segments. Each of these reel stops are typically the same size, with one reel symbol per reel stop or symbol segment. In some embodiments, a given reel may have empty reel stops (i.e., blanks or ghosts), with the blank segments typically being the same size as the segments having actual reel symbols. For example, where a given reel strip might have 17 reel stops, with 10 of the reel stops having actual visibly apparent reel symbols, there would then be 7 different "blanks" or ghost regions having large amounts of blank or empty space. Overall, the 17 reel stops along the reel could be evenly spaced and of the same size. Of course, reels having a different number of reel stops and/or a different percentage of reel stops that are blanks can also be used. In fact, in many embodiments, it may be desirable to use reels having no blanks.

Figure 3A:
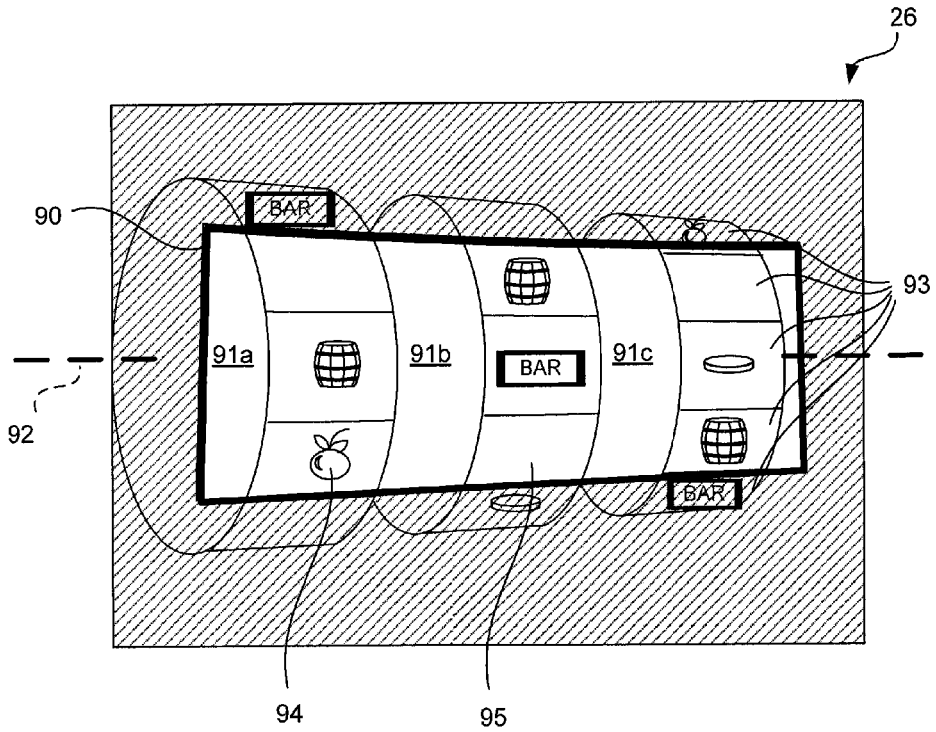
FIG. 3A illustrates in partial perspective view three exemplary adjacent rotating reels adapted for use in a gaming machine.
Figure 3B:
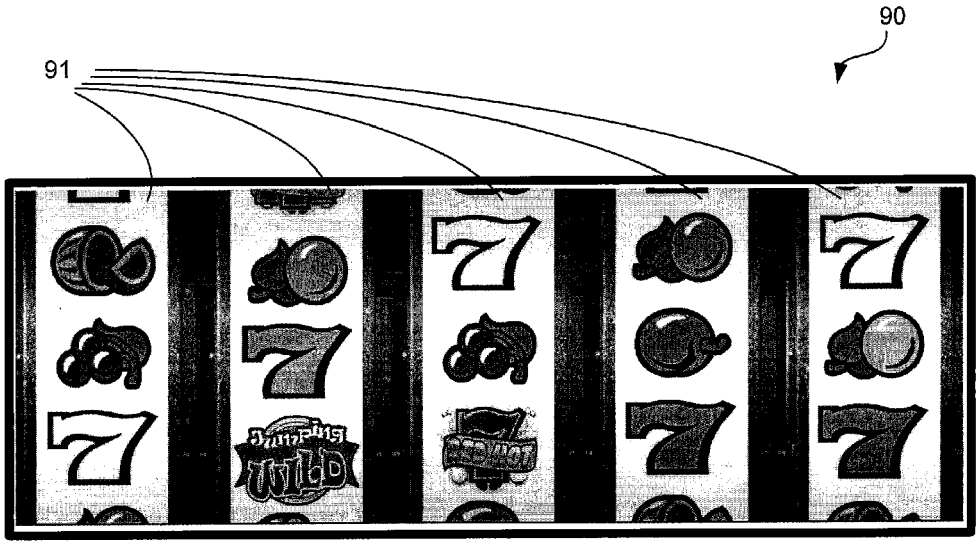
FIG. 3B illustrates a screenshot in front elevation view of five exemplary adjacent virtual rotating reels adapted for use in a processor-based gaming machine.

Turning now to FIGS. 3A and 3B, two different examples of adjacent rotating reels adapted for use in a gaming machine are presented. As will be readily appreciated, such adjacent rotating reels can be actual physical mechanical reels, such as the three adjacent reels presented in FIG. 3A, or they can be virtual reels emulated on the display of a processor based gaming machine, such as the five adjacent reels shown in the screenshot of FIG. 3B. It will be readily appreciated that many of the items and features involved in the presentation of such gaming reels are common to both physical mechanical reels and virtual simulated reels, such that the various exemplary items and features of both types of reels described herein can apply similarly to the other type of reel. For example, while the three reels of FIG. 3A are described here as physical mechanical reels, they might also be virtual (i.e., simulated mechanical) reels that could be shown on a video display 26 of processor-based gaming machine 10.

As shown in FIG. 3A, gaming reels 91*a*, 91*b* and 91*c* are adapted to rotate about a common axis 92, such as during game play. Each wheel has a plurality of reel stops 93, each of which contains one static reel symbol 94 or, in some embodiments, only empty space comprising a "ghost" or "blank" 95. Each static reel symbol 94 or blank 95 is generally contained within its own reel stop 93. Static reel symbols 94 can include bars, fruits, coins, or barrels, as shown, and/or may also include a vast variety of other symbols suitable for use in a reel game, as will be readily appreciated. A viewing window 90 is adapted such that reels 91*a*, 91*b* and 91*c* can be seen therethough, and it will be understood that such a viewing window can be used on wager-based gaming machines that include virtual reels on a video display. As can be seen, viewing window 90 is adapted such that only some of the reel stops 93 may be seen, while others are hidden from view. For example, reel 91*c* has reel stops 93 containing a blank, a coin and a barrel that can be seen, and also reel stops containing a cherry and a bar that cannot be seen at the same time through viewing window 90. As shown, reels 91*a*, 91*b* and 91*c* are stopped such that a barrel, a bar and a coin are the visible reel symbols on the reel stops that have stopped across a center payline visible at the center of viewing window 90.

FIG. 3B depicts five adjacent virtual reels 91, which reels can be substantially similar to the three reels of FIG. 3A. For example, each of the five virtual reels is visible through a viewing window 90, and various visible reel symbols from the reel stops of virtual reels 91 can be seen through the viewing window, while others cannot be seen therethrough at the same time. Reel symbols include cherries, watermelons, plums, oranges, other fruits and various numeral "7"s of different colors and designations, as well as "wild" symbols. Of course, many other specific reel symbols may also be used in addition to or instead of the examples that are illustrated. Unlike the three-reel example of FIG. 3A, the five-reel example of FIG. 3B does not include any reel stops that comprise ghosts or blank regions. It will be readily appreciated that the various embodiments of the present invention may be practiced with or without gaming reels that have reel stops thereupon. In general, many gaming reels, such as those shown in FIGS. 3A and 3B are configured such that three reel stops are in full view through the applicable viewing window. It will be understood, however, that other embodiments might be used that result in more or fewer reel stops per reel being visible at any given time, such as via different sizes in reel stops and/or the viewing window.

Various embodiments of the present invention relate to the more realistic presentation of simulated moving rotating reels on a processor-based gaming machine, such as on a video display. This can be done by replacing various static reel symbols with corresponding substitute blurred reel symbols during times when the simulated reels are in motion. Such reel symbol blurring and substituting can be done via the use of a specialized blurred reel symbol generator, as described herein. Such blurring of the various reel symbols is generally intended to simulate the direction of movement of those reel symbols as they are portrayed to be in motion.

In general, the blurring of graphical images can be done by way of either a "depth of field" blur or a "directional" or motion-based blur. A depth of field blur tends to blur or obscure the graphical object or image uniformly or roughly uniformly in all directions or on all sides. Such a depth of field blur might be used to simulate a still object that is going out of focus for any of a variety of reasons. Conversely, a directional or motion blur tends to blur or obscure the graphical object or image in a particular direction of motion, so as to simulate the motion of that object in that direction. For example, directional blur for a reel symbol that is moving in a top to bottom direction on a virtual rotating reel could be focused in a "−Y" direction with respect to its display. Little or no directional blur could be used for an object that is moving relatively slowly, while a significant amount of directional blur could be introduced to simulate an object that is moving relatively quickly. Unless specified otherwise, use herein of the terms "blur," "blurred," "blurring" and other similar terms shall generally correspond to a directional blur, since an important aspect of the present invention is to provide the improved emulation of objects that are in motion.

Figure 4:
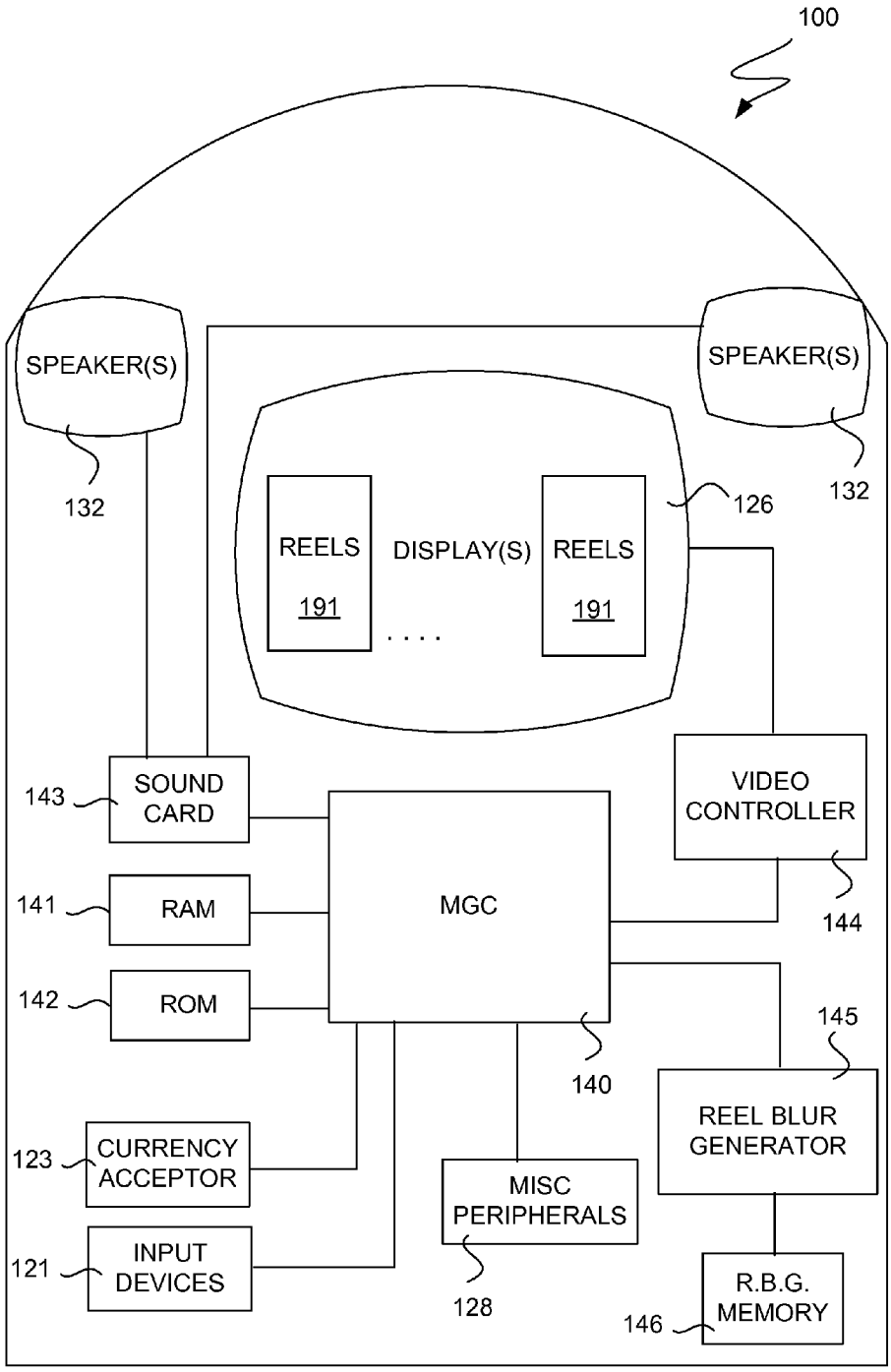
FIG. 4 illustrates in block diagram format various components of an exemplary processor-based gaming machine adapted to provide substitute blurred reel symbols according to one embodiment of the present invention.

Referring to FIG. 4, various components of an exemplary processor-based gaming machine adapted to provide substitute blurred reel symbols according to one embodiment of the present invention are illustrated in block diagram format. Processor-based gaming machine 100 contains many components that can be similar or identical to those set forth in gaming machine 10 above. For example, display(s) 126, speakers 132, input devices 121 and currency acceptor 123, as well as other peripheral devices 128, can correspond to similar items in gaming machine 10. One or more sound cards 143 can aid to drive speakers 132, and one or more video cards or controllers 144 can be used to drive display(s) 126, which display(s) are preferably adapted to present one or more gaming reels 191.

As noted above, a master gaming controller 140 adapted to execute or control one or more aspects of wager based games is in communication with various other gaming machine components, either directly or via other components. For example, while master gaming controller 140 might be in direct communication with various input devices or other peripherals, a video card or controller 144 can be interspersed between the master gaming controller and display 126, such that communication to the display is indirect. Various memory or storage components, designated as RAM 141 and ROM 142 might be accessible to master gaming controller 140, and such storage components may be dedicated to the master gaming controller, or could be shared by other gaming machine components.

In addition, a specialized reel blur generator 145 can be located within processor-based gaming machine 100. Preferably, reel blur generator 145 is adapted to configure one or more simulated rotating reels for presentation on a display 126 of gaming machine 100. This reel blur generator 145 can be a dedicated processor located separately from master gaming controller 140, as shown in FIG. 4, so as to alleviate some of the burdens that are typically placed on the master gaming controller. Such a separate processor could be, for example, the Pentium III processor chip made by Intel Corporation of Santa Clara, although other suitable processors can also be used. Alternatively, this blurred reel symbol generator can be contained within or even be a part of the master gaming controller itself (not shown). Blurred reel symbol generator 145 may be in communication with master gaming controller 140, video controller 144 and/or display(s) 126.

One or more reel blur generator storage units or memory devices 146 can be associated with reel blur generator 145, and such generator memory devices can be dedicated to the reel blur generator or shared with other machine components. Such generator memory devices 146 could be specific memory chips and/or also an internal hard disk drive, such as, for example, a 40 gigabyte model 6K040L0 hard drive made by Maxtor Corporation of Milpitas, Calif., although other suitable memory components can also be used. Such generator memory devices 146 can be used to store files containing, for example, original and modified versions of static reel symbols, original and modified versions of substitute blurred reel symbols, original and modified versions of entire virtual reel strips, and data regarding virtual reel rotational speeds, among other items, as may be desired.

In various embodiments, blurred reel symbol generator 145 facilitates the display of simulated rotating reels upon display device 126, such as by configuring at least one simulated rotating reel such that one or more of the static reel symbols thereupon are replaced by corresponding substitute blurred reel symbol or symbols. Such a configuring can be a reconfiguration of the simulated rotating reel or reels. That is, for each simulated rotating reel, there can be a "static" version that displays static reel symbols when the reel is at rest, and also a "dynamic" version that displays substitute blurred reel symbols when the reel is in motion, such as, for example, the typical rotational motion that is depicted during an actual game play involving the reel or reels. The "reconfiguration" of the simulated or virtual reel or reels then can involve transitioning the reel or reels from static reel symbols to blurred reel symbols, such as to depict non-moving reels becoming moving, or vice versa, such as when the reels are moving and then come to rest to display a game outcome.

The visual results of switching out static reel symbols for substitute blurry or blurred reel symbols when their respective reels are in rotational motion can be advantageous on several levels. From an overall appearance perspective to the human eye, the use of substitute reel symbols when reels are in motion can result in a more realistic and natural simulation of real mechanical rotating reels. Furthermore, the eye strain and/or fatigue that can accompany a more realistic simulation of rotating reels can be reduced or eliminated by various uses of such blurred reel symbols, such as by blending blurred reel symbols together and/or reducing or eliminating white or bright spaces between reel symbols, as set forth in greater detail below. The results of such specific features in the use of substitute blurred reel symbols can reduce the straining effects of the natural tendency of the human eye to try to follow a discretely detectable object (such as a clear static reel symbol) in motion, and can also reduce the fatiguing effects of any rapid "flickering" between colored images and white or bright spaces.

Figure 5A:
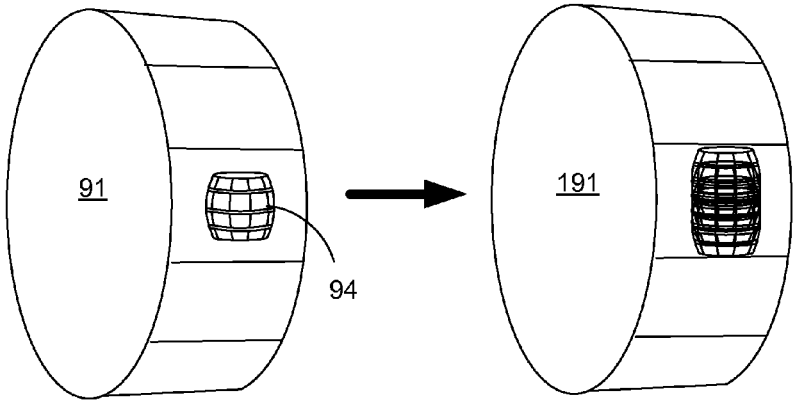
FIGS. 5A through 5C illustrate in perspective view various exemplary rotating reels having static reel symbols that are changed to corresponding substitute blurred reel symbols according to one embodiment of the present invention.
Figure 5B:
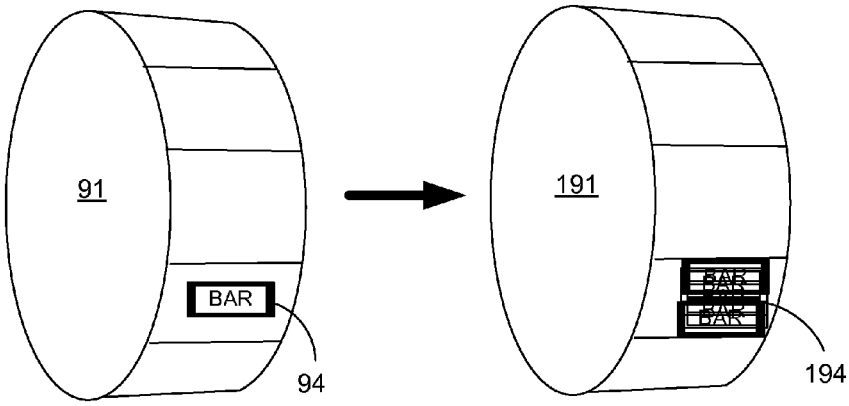
Figure 5C:
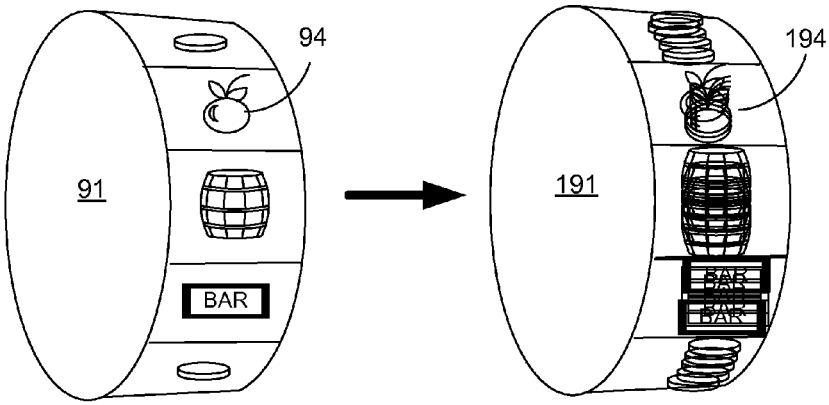

Examples of rotating reels having static reel symbols that are changed to corresponding substitute blurred reel symbols according to various embodiments of the present invention are provided in perspective view in FIGS. 5A through 5C. In FIGS. 5A and 5B, existing virtual rotatable or "rotating" reel 91 is illustrated with a particular existing static reel symbol 94, a barrel and a bar respectively. As a result of a corresponding blurred reel symbol substitution reconfiguration or process, the resultant reel 191 contains a substitute blurred reel symbol 194 that corresponds to old static reel symbol 94. As will be readily appreciated, original reels 91 can be used for display when the virtual reels are to be shown at rest, and reconfigured reels 191 can be displayed when the virtual reels are to be shown in motion, particularly rotational motion. In these particular illustrations, the substitute blurred reel symbols 194 have been stretched to the top and bottom ends or boundaries of their respective reel stops, although it will be appreciated that such stretching might extend these blurred reel symbols short of or beyond one or both reel stop ends.

In FIG. 5C, existing virtual reel 91 is illustrated with a plurality of existing or original static reel symbols 94, in particular a coin, cherry, barrel, bar and coin from top to bottom. As a result of a corresponding blurred reel symbol substitution reconfiguration or process, the resultant reconfigured reel 191 contains a substitute blurred reel symbol 194 for each corresponding static reel symbol 94. As in the foregoing examples of FIGS. 5A and 5B, each substitute blurred reel symbol has been stretched such that it extends from the top to bottom end of its respective reel stop. Such a process can be made with respect to every static reel symbol across the entire circumference of the reel. One result of such a reconfiguration process is that one continuous "blur" of reel symbols can be created. In some embodiments, there can be small amounts of light or bright spaces between blurred reel symbols (i.e., stretching of the blurred reel symbols is not done to the ends of their respective reel stops), while in other embodiments, stretching can be done past the ends of respective reel stops, such that there is some amount of interlacing or blending of blurred reel symbols at the tops and bottoms of some or all of the blurred reel symbols.

Figure 6A:
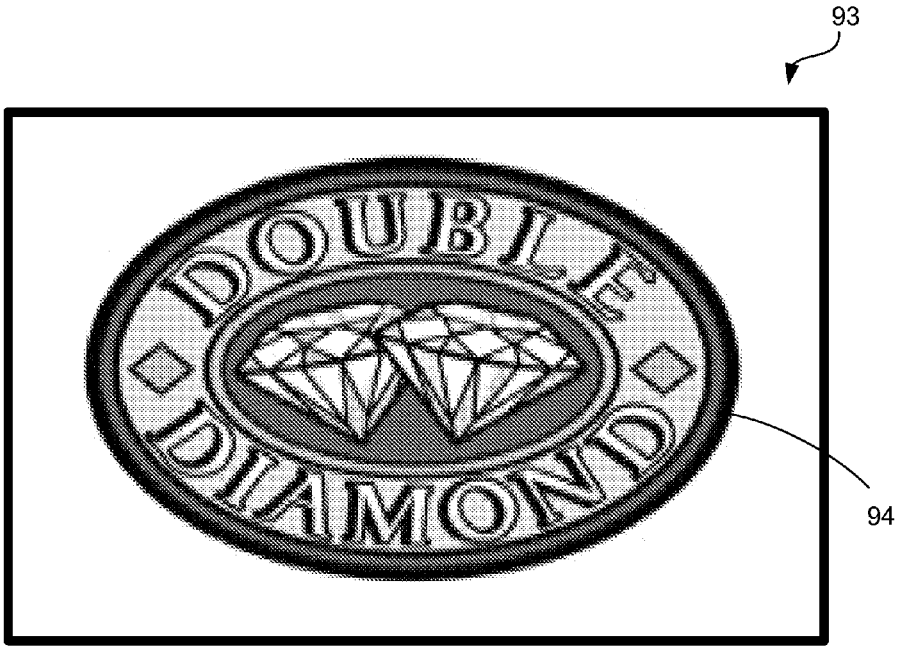
FIG. 6A illustrates a screenshot in front elevation view of one exemplary static reel symbol adapted for use in a processor-based gaming machine.
Figure 6B:
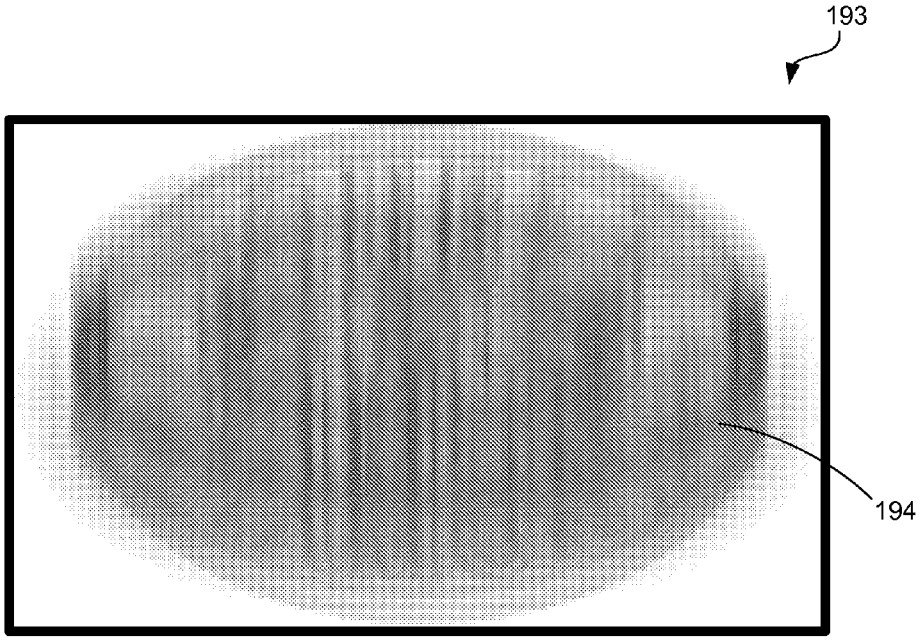
FIG. 6B illustrates a screenshot in front elevation view of one exemplary substitute blurred reel symbol corresponding to the static reel symbol of FIG. 6A according to one embodiment of the present invention.

Moving next to FIGS. 6A and 6B, one particular example of a static reel symbol and its corresponding substitute blurred reel symbol is set forth in screenshot format. In both figures, a given reel stop 93 on an associated virtual reel is shown. It will be readily appreciated that reel stop 93 typically does not change in size upon the replacement of a static reel symbol with a corresponding substitute blurred reel symbol thereupon, although variations that involve reel stop size changes may be used, as may be desired. In FIG. 6A, static reel symbol 94 is a "Double Diamond" reel symbol that is adapted to be shown on a virtual gaming reel at rest. Conversely, FIG. 6B illustrates a deliberately blurred reel symbol 194 that corresponds to such a "Double Diamond" static reel symbol, with such a blurred reel symbol being adapted to be shown on a virtual gaming reel in motion.

In general, the human eye, when blinking, rotating or otherwise changing its vision, can typically perceive the last symbol that appeared in focus on a rotating reel before the change in vision. Thus, while the eye may be focused on what appears to be a blur of rapidly moving reel symbols for a set period of time, a change in vision from this focus on a given reel can result in a split-second clearer perception of the last reel symbol that was being viewed. Accordingly, the blurred reel symbol 194 is preferably not an entire blur, but rather can contain various details and elements that would be readily perceptible to a viewer who is experiencing this visual phenomenon with respect to this particular symbol. As such, a player viewing a virtual reel full of blurred reel symbols in motion will likely be able to know which of these particular reel symbols was last seen upon blinking or turning away from the display. In this case, the viewer would know that the "Double Diamond" reel symbol was last seen.

Upon a gaming reel reconfiguration as generally described herein, static reel symbol 94 of FIG. 6A is replaced with its corresponding blurred reel symbol 194 of FIG. 6B. Such a blurred reel symbol 194 can be one that is stored on an associated memory device and recalled for this use, or can be generated on the fly by an associated reel blur generator. A further reconfiguration can involve blurred reel symbol 194 being replaced by static reel symbol 94, such as when a subject moving reel is being transitioned back to a static reel.

As applied to vertically moving reel symbols specifically, such as the "Double Diamond" reel symbol of this example, the use of a directional blurring process to emulate the movement or rotation of such reel symbols will typically result in more blurring about the top and bottom of the reel symbols than on the sides. Of course, in instances where reels might be moving horizontally, then the opposite would be true. Other directions of rotation may also be used for a given reel or set of reels, and it will be readily appreciated that any directional blur to be introduced with respect to any reel symbols or other images for such reels shall generally be in the direction of rotation or movement. In fact, a more accurate portrayal of directional blur can usually be had where there is more blur at the trailing edge of a moving object. In the case of a reel symbol that is vertically rotating from top to bottom, this would tend to result in an intentionally blurred reel symbol with the most blur along the top edge, a significant amount of blur along the bottom edge, and relatively little or no blur along the left and right side edges.

As will be readily appreciated, numerous variations, features and details can be practiced with respect to the deliberate blurring of reel symbols. One such variation or feature can include altering the size or scale of a blurred reel symbol, such as to stretch or otherwise expand the size of the blurred reel symbol in a direction of the rotation of its respective rotating reel. Stretching or expansion may also be made in other directions, as may be desired. In many embodiments, however, the size of a typical substitute blurred reel symbol is the same as its corresponding reel symbol in a direction that is perpendicular to the direction of rotation of its respective simulated rotating reel. That is to say, a typical blurred reel symbol on a vertically rotating virtual reel can be stretched such that it extends about to or beyond the top and bottom edges of its respective reel stop, but not stretched or resized at all in a horizontal direction across its reel stop.

Another variation or feature can be to change or adjust the opacity of various blurred reel symbols with respect to their corresponding static reel symbols. In this manner, the various colors of the blurred reel symbols can be made "softer" in appearance for the simulated spinning motion of their respective reels. This can involve the "smearing" or melding of white or brighter colors into darker colors, so as to reduce the amount of flashing or flicker that is experienced when the blurred reel symbols are displayed in rapid motion. Such an opacity adjustment can also be a result of the foregoing stretching and/or potential interlacing or blending of blurred reel symbols at their edges. As will be readily appreciated, one favorable result of such a stretching of blurred reel symbols is the significant reduction or elimination of white or bright spaces between reel symbols. Again, such a feature serves to reduce the amount of flashing or flicker that tends to fatigue the eyes of players or viewers.

Still another variation or feature can be to adjust the apparent sequence speeds and/or acceleration rates at which the reel or reels appear to be rotating on the associated display. As will be readily appreciated, the rate at which virtual reels accelerate and the ultimate speeds at which they rotate can have a significant effect on the perceptions of players and viewers. Appropriate rates of acceleration and top rotational speeds for virtual reels can vary depending on the colors, types, sizes and relative spacings of the reel symbols used, among other factors. The use of blank reel stops or symbols may also affect what is optimal with respect to the rotational speeds and blurring of the actual visual reel symbols.

While in motion, the period of time taken for a given reel stop to pass through a given point can be any of a wide variety of elapsed time periods. In some embodiments involving a wide variety of reel symbols, it is though that a suitable time for the elapsed time for one reel stop to pass through a given point on a display device can range from about 35 to 100 milliseconds. Such a reel stop can vary in size, although it is typical to have all reel stops be roughly the same size, and typical to have about 17 reel stops per reel, although other numbers may also be used. In many such embodiments, the elapsed time for a given reel stop to pass through a given point on a display device can range more specifically from about 50 to 60 milliseconds. Still further, the elapsed time for such a reel stop to pass through a given point can be about 57 milliseconds for many common or simple reel symbols. Of course, many elapsed time periods outside of the range of 35 to 100 milliseconds may also be applied.

As a result of implementing one or more of the foregoing features, the overall eye strain and/or fatigue that can accompany the simulation of rotating reels using blurred reel symbols can be significantly reduced or eliminated. Thus, the resulting moving reel presentation can be more appealing to many players.

In some embodiments, the use of blurred reel symbols can involve the manual design creation of blurred reel symbols that resemble corresponding existing static reel symbols, such as by graphic design individuals or staff. In other embodiments, this can involve the automated creation of such blurred reel symbols. For example, specialized reel blur generator 145 can be adapted to take existing static reel symbols from an existing virtual reel strip, and blur those reel symbols in an automated fashion according to one or more input parameters in order to create the corresponding blurred reel symbols. Such parameters could include, for example, various color, opacity, stretching, repeat symbol amounts, repeat symbol spacing and reel speeds, among other blurred reel symbol and virtual reel creation factors. Under either the manual or automated creation of blurred reel symbols, such blurred reel symbols could be stored at an associated memory for later recall and use.

As one particular example, where it is desired to stretch a blurred reel symbol so that its vertical length doubles or otherwise increases in size, the symbol script for that blurred reel symbol can be altered on whatever scale or scales might be needed. Such a change might involve adding a particular line or lines of code to existing code for a reel symbol. For example, and depending on specific code elsewhere in the script, the following extra line could be added to the end of the script file for an existing virtual reel symbol:

"setRelativeScale(1.0f,1.5f,1.0f)"

where the middle "1.5f" value would represent stretching the blurred reel symbol just to the ends of its respective reel stop. A lower value, such as "1.4f" might be used where some small amounts of white space between blurred reel symbols is desired, and a larger value, such as "1.6f" might be used where overstretching and the resulting interlacing of blurred reel symbols is desired. Depending upon the particular code conventions and parameters used, such an added line or lines of code may result in blurred reel symbols that are stretched to about double in size in a vertical direction, but that are not stretched in any other direction. Of course, other specific lines of code may also be used, and such code changes may involve added lines and/or changes to existing lines of code. Different scales might be also used, and stretching in a horizontal or other direction might also be implemented.

In various embodiments, the reel blur generator can be adapted to generate blurred reel symbols "on the fly." That is, given a set of static reel symbols to be displayed on virtual reels for a particular reel type game, the reel blur generator could generate corresponding blurred reel symbols at or about runtime, when such blurred reel symbols are to be displayed on the moving virtual reels. In such embodiments, a second set of blurred reel symbols might not need to be stored on any system components, since the reel blur generator would be adapted to blur a static reel symbol for display on a moving virtual reel once it has the graphics or script code for the static reel symbol. Such automated blurring of a static reel symbol could be done in the manner described above with respect to blurred reel symbols that are generated and stored in automated fashion. In some embodiments, such automated blurring on the fly could be facilitated by using existing functions in the video driver software, which functions might allow the video driver to take the static graphics for a specific image (e.g., reel symbol) and produce an emulated blurred image for those graphics.

In various alternative embodiments, the reel blur generator and/or one or more similar components can be used to generate substitute directional blur images for graphical objects that are not reel symbols and/or not on virtual rotating reels. For example, a shooting star moving across the display screen might start and/or finish as a visible static graphical object. However, the static graphic for such a shooting star can be replaced by a substitute corresponding blurred graphic for those times during which the shooting star is moving across the display screen. Such a process for substituting in a corresponding blurred graphic can be identical or similar to those processes disclosed herein for providing blurred reel symbols. Of course, substitute blurred images or graphics could be used for a wide variety of objects and images, and do not need to be limited to just a shooting star. In such cases, the reel blur generator or similar graphical motion blurring component might be referred to more generally as a graphical object blur generator.

It will be readily appreciated that the various disclosures herein with respect to processor-based gaming machines, virtual reels and methods involving the deliberate blurring of substitute reel symbols to better simulate motion can also be applied to wager-based gaming systems having networked gaming machines and other network components. Such systems can include components and configurations such as those described above with respect to FIG. 2. In particular, such a wager-based gaming system can include a remote host that is in communication with some or all of the processor-based gaming machines, with the remote host being adapted to download static reel symbols, blurred reel symbols, virtual reel strips, or any combination thereof to the networked gaming machines. Where gaming machines are to be networked in such a wager-based gaming system, various gaming machine embodiments can also include a network interface (not shown) coupling the gaming machine to the system and its various remotely located networked components. Such a network interface would preferably facilitate the downloading of static reel symbols, blurred reel symbols, virtual reel strips, or any combination thereof to the networked gaming machines.

Such reel symbols and/or reel strips can be stored, for example, at database 70, and then be made available to various gaming machines within the gaming system. Storage of various virtual reel symbols and entire virtual reels or reel strips can be made with respect to both original versions of static reel symbols and one or more corresponding blurred versions thereof. As such, blurring of the same reel symbol or reel strip can be done in different scales, with each such blurring being used and/or stored separately. Such different versions might be desirable, for example, where one gaming jurisdiction might place limits on various effects that a virtual gaming reel might be able to display. In such a gaming system, the blurring of static reel symbols to create corresponding substitute blurred reel symbols, as well as the creation of entire reel strips having such blurred reel symbols, can be done before or after a download from a remote host to a given gaming machine.

Such reel blur generation can be done by a network component, such as at the remote host, or within an individual gaming machine. Accordingly, a reel blur generator may be located at the remote host, or elsewhere within the gaming system and outside of an individual gaming machine. Such a remotely located reel blur generator could be beneficial to an overall system, particularly where such a system might have gaming machines that are not equipped with reel blur generators themselves. For example, where it is desirable for a system gaming machine to provide a reel-type game having reels with substitute blurred reel symbols for the display of reels in rotational motion, a reel blur generator on the network could provide appropriate substitute blurred reel symbols or entire substitute virtual reels having such blurred reel symbols where the gaming machine is not equipped to make such adjustments itself.

In some embodiments, reel blur generators can be located both within individual gaming machines, as detailed above, and also on one or more system components, such as at a remote host. Whether a reel blur generator is located on a system component or within a gaming machine, it is preferable that such a reel blur generator be able to take an input of an existing or preset virtual reel having various static reel symbols and reconfigure that existing or preset virtual reel such that its static reel symbols are replaced with corresponding blurred reel symbols when that virtual reel is displayed in rotational motion. A resultant "reconfigured" virtual reel can then be used by one or more system gaming machines, and can also be stored for future use. Such storage might be on a system storage component, such as database 70, and/or at a local gaming machine storage device, such as at generator memory 146. Thus, where a preset virtual reel or reel strip has preset graphics and locations for each static reel symbol, the reel blur generator would be adapted to read these symbols and their locations, and then provide the appropriate corresponding substitute blurred reel symbols accordingly.

Figure 7:
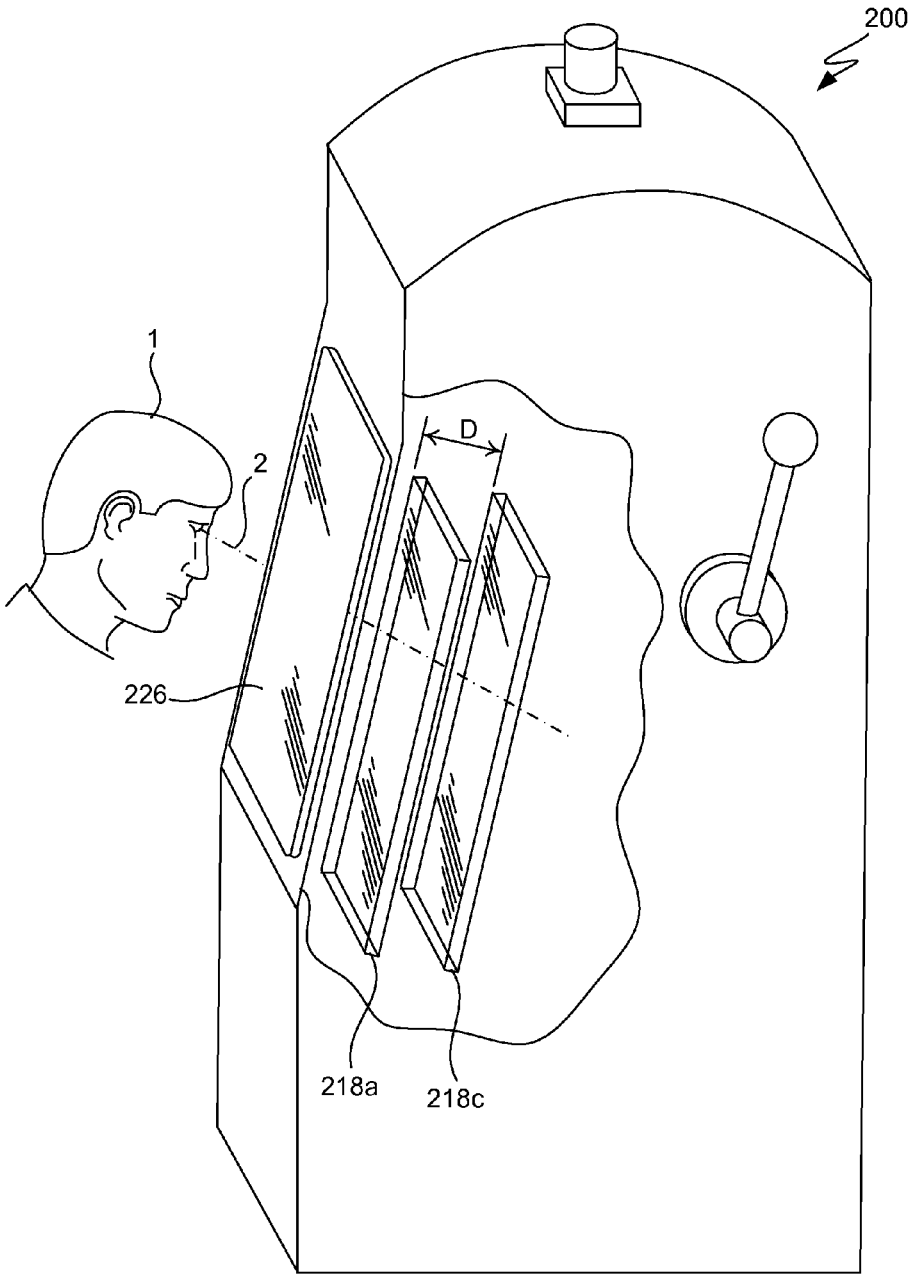
FIG. 7 illustrates in partial perspective and cut-away view an exemplary processor-based gaming machine having a multi-layer display according to one embodiment of the present invention.

Turning now to FIG. 7, an exemplary processor-based gaming machine having a multi-layer display according to one embodiment of the present invention is illustrated in partial perspective and cut-away view. Although the various gaming machines, devices, systems and methods involving substitute blurred reel symbols set forth herein can be used on any type of processor-based gaming machine or system adapted to simulate rotating gaming reels, it is specifically contemplated that such devices and techniques can be applied to a gaming machine, terminal or system having a multi-layer display, such as multi-layer display gaming machine 200.

Such layered displays in a gaming machine can include those that are from or similar to, for example, that which is commercially available from Pure Depth of Redwood City, Calif. The Pure Depth technology incorporates two or more LCD displays into a physical unit, where each LCD display is separately addressable to provide separate or coordinated images between the LCDs. Many Pure Depth display systems include a high-brightened backlight, a rear image panel, such an active matrix color LCD, a diffuser, a refractor, and a front image plane; these devices are laminated to form a stack. The LCDs in these units are stacked at set distances, such as distance "D." As well as the binocular depth cue, Pure Depth units feature intrinsic motion parallax, where the x and y distance changes between objects displayed on different video planes depending on viewing angle. In addition, separate focal planes may literally be brought in and out of focus depending on the focal length of the lens in the viewer's eye.

The layered display devices 218*a*, 218*c*, which may be layered LCD devices, for example, may be used in a variety of manners to output games on a gaming machine. In some cases, video data and images displayed on the display devices 218*a* and 218*c* are positioned such that the images do not overlap (that is, the images are not superimposed). In other instances, the images overlap. It should also be appreciated that the images displayed on the display screen can fade-in fade out, pulsate, move between screens, and perform other inter-screen graphics to create additional affects, if desired. Additional layers of display devices may also be introduced, although the present description will continue with just two layered display devices for purposes of simplicity here.

In a specific embodiment, display devices 218*a* and 218*c* display co-acting or overlapping images to a person or viewer 1 looking at the display devices at a front display screen 226 and along a line-of-sight 2. For example, front display device 218*a* may display paylines in transparent portions that illuminate winning combinations of reels disposed on display device 218*c*. With respect to further examples, it is again noted that external loading and changing of simulated reel games can be had with gaming machine 200, such as described above with respect to wager-based gaming system 50. This can permit a casino or gaming establishment to change video on each of the layered display devices, and their transparency, without physically altering the gaming machine or requiring maintenance. Thus, the number of virtual slot reels may be changed from 3 to 5 to 9, or some other number. In this case, each display device 218*a*, 218*c* can change the position of its viewing window for viewing of the different number of virtual slot reels. Symbols on each virtual slot reel may also be changed. Also, a pay table shown on front display device 218*a* may be changed at will, in addition to changing whether a bonus or progressive game is shown on the back display device 218*c*, for example. This permits the same gaming machine 200 to play new games simply by downloading data onto the machine.

As will be readily appreciated, the layered display devices 218*a*, 218*c* may be used in a wide variety of manners to output games on a gaming machine. In some cases, video data and images displayed on the display devices 218*a* and 218*c* are positioned such that the images do not overlap, while in other instances, the images do overlap. It should also be appreciated that the images displayed on the display screen can fade-in fade out, pulsate, move between screens, and perform other inter-screen graphics to create additional affects, if desired. The multiple display devices may each display their own graphics and images, or cooperate to provide coordinated visual output. Objects and graphics in a game may then appear on any one or multiple of the display devices, where reels and other graphics on the front screen 218*a* blocks the view objects on the back screen 218*c*, depending on the position of the viewer relative to the screens. This provides actual perspective between the graphics objects, which represents a real-life component of 3D visualization.

In some embodiments, the multiple display devices output video for different games or purposes. For example, one display device may output a reel game, while another display device outputs a bonus game or pay table associated with the other display, while still another display device provides a progressive game or is reserved for player interaction and video output with a touchscreen. Other combinations may be used, as may be desired.

Reel games output by the display devices in such a multi layer display may include any video game that portrays one or more reels. Typically, the gaming machine simulates 'spinning' of the video reels using motion graphics for the symbols on the reel strips and motion graphics for the mechanical components. The virtual reels for such a game can be reels that have had static reel symbols replaced with corresponding blurred reel symbols, as disclosed herein. In various particular embodiments, the deliberate blurring of reel symbols may be made to account for any special effects that are desired through the use of a multi layer display. For example, the blurring of reel symbols that are to displayed on front layered display 218*a* might be more exaggerated that the blurring of the same or similar reel symbols that are to be displayed on back layered display 218*c*, or vice versa, depending upon the visual effects that are desired.

Method of Use

It will be readily appreciated that the method and illustrative flowchart provided herein are merely exemplary, and that the present invention may be practiced in a wide variety of suitable ways. While the provided flowchart may be comprehensive in some respects, it will be readily understood that not every step provided is necessary, that other steps can be included, and that the order of steps might be rearranged as desired by a given manufacturer, as desired.

Figure 8:
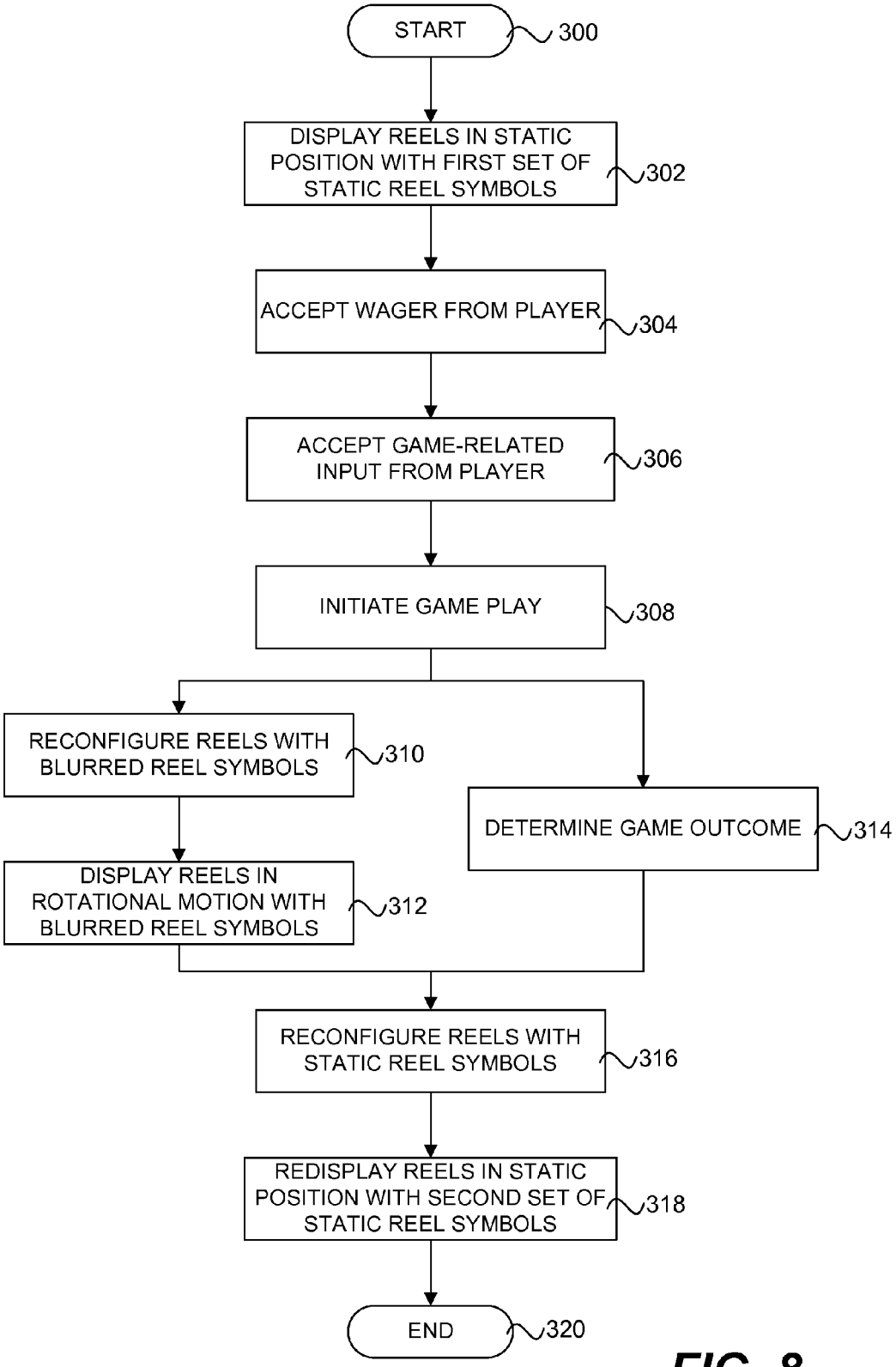
FIG. 8 illustrates a flowchart illustrating an exemplary method of presenting simulated reels on a processor-based gaming machine according to one embodiment of the present invention.

Specifically, FIG. 8 illustrates a flowchart illustrating one exemplary method of presenting simulated reels on a processor-based gaming machine according to one embodiment of the present invention. Such a method serves to illustrate an automated process whereby a specialized reel blur generator is adapted to replace static reel symbols with corresponding substitute blurred reel symbols for an existing virtual reel or reel strip, for example. The method may also be applied to the manual or automated creation of blurred reel symbols or reel strips containing such blurred reel symbols, such as the original design of graphics for a virtual reel.

After start step 300, a first process step 302 involves selecting displaying one or more virtual gaming reels having a plurality of static reel symbols thereupon in a static position on a display of the gaming machine. Such a gaming reel or reels can be, for example, any of the exemplary gaming reels as described above, such as a virtual gaming reel existing on or being downloaded to a system gaming machine, for instance. As displayed, a first set of static reel symbols are shown to a player at process step 302. Process step 304 then involves accepting a wager from the player, process step 306 involves accepting a game related input from the player, and a game play is then initiated at process step 308.

After game play is initiated at step 308, the subject reel or reels are reconfigured with blurred reels symbols at process step 310. Such blurred reel symbols can correspond to and be substitutes for the static reel symbols, as set forth above. At process step 312, the subject reels having the blurred reel symbols are then displayed in rotational motion. Simultaneously with, before, or after steps 310 and 312, a game outcome for the subject game is determined at process step 314. At a following process step 316, the subject reels are reconfigured with the static reel symbols again, and these reels are displayed in static position at process step 318. As redisplayed, a second set of static reel symbols are shown to the player at step 318. After process step 318, the method then finishes at end step 320. Of course, additional steps may also apply to such a process, as may be desired.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A method of presenting simulated reels on a processor-based gaming machine adapted for accepting a wager, playing a reel-type game based on the wager and granting a payout based on the result of the wager-based reel-type game, comprising:

displaying on a display device of said processor-based gaming machine, a plurality of simulated rotating reels, said plurality of simulated rotating reels including a plurality of reel symbols distributed on a plurality of reel stops thereupon; and facilitating the display of said simulated rotating reels upon said display device using a reel blur generator in communication with at least one master gaming controller of said processor-based gaming machine and said display device, wherein said reel blur generator reconfigures at least one of said simulated rotating reels such that one or more of said plurality of reel symbols are replaced by one or more corresponding substitute blurred reel symbols when said simulated rotating reels are depicted in motion on said display device.

2. The method of claim 1, wherein said one or more substitute blurred reel symbols appears blurry regardless of whether said one or more substitute blurred reel symbols are static or moving on said display device.

3. The method of claim 1, wherein each of said one or more substitute blurred reel symbols simulates the appearance of its corresponding reel symbol when said corresponding reel symbol is moving on said display device.

4. The method of claim 1, wherein the size of each of said one or more substitute blurred reel symbols is larger than its corresponding reel symbol in the direction of rotation of its respective simulated rotating reel.

5. The method of claim 4, wherein the size of each of said one or more substitute blurred reel symbols is the same as its corresponding reel symbol in a direction that is perpendicular to the direction of rotation of its respective simulated rotating reel.

6. The method of claim 1, wherein each of said plurality of reel symbols is replaced by a corresponding substitute blurred reel symbol when said simulated rotating reels are depicted in motion on said display device.

7. The method of claim 6, wherein each of said one or more substitute blurred reel symbols simulates the appearance of its corresponding reel symbol when said corresponding reel symbol is moving on said display device.

8. The method of claim 6, wherein said one or more of substitute blurred reel symbols is stretched with respect to its corresponding reel symbol in the direction of rotation of its respective simulated rotating reel.

9. The method of claim 8, wherein said substitute blurred reel symbols are collectively stretched such that each substitute blurred reel symbol substantially contacts another substitute blurred reel symbol at both of its top and bottom ends.

10. The method of claim 1, wherein said processor-based gaming machine presents said plurality of simulated rotating reels on said display device such that said rotating reels appear to be in motion, and wherein the elapsed time for one reel stop to pass through a given point on said display device is from about 35 to 100 milliseconds.

11. The method of claim 10, wherein each of said plurality of reel stops are substantially equal in size.

12. The method of claim 10, wherein said elapsed time is about 50 to 60 milliseconds.

13. The method of claim 10, wherein said elapsed time is about 57 milliseconds.

14. The method of claim 1, wherein said reel blur generator generates said one or more substitute blurred reel symbols automatically.

15. The method of claim 1, wherein said reel blur generator reconfigures said at least one of said simulated rotating reels with one or more substitute blurred reel symbols that have already been created.

16. The method of claim 1, wherein:

said reel blur generator is in communication with a storage device, said storage device storing a plurality of files with respect to said one or more substitute blurred reel symbols.

17. The method of claim 1, wherein:

a network interface couples said processor-based gaming machine to one or more remotely located networked components, said network interface facilitating the downloading of substitute blurred reel symbols to said processor-based gaming machine.

18. The method of claim 1, wherein said reel blur generator is located at a remote host.

19. The method of claim 1, wherein said one or more substitute blurred reel symbols appears to have more blur at a trailing edge thereof relative to the direction of rotation of its respective simulated rotating reel.

20. The method of claim 19, wherein the direction of rotation of the simulated rotating reel is from top to bottom with the most blur of the substitute blurred reel symbol occurring along the top edge thereof.

* * * * *